United States Patent [19]

Nichols

[11] 4,141,197

[45] Feb. 27, 1979

[54] GUARD FOR A HORSE'S TAIL IN A TAIL SET

[76] Inventor: William C. Nichols, 36W788 Red Gate Rd., St. Charles, Ill. 60174

[21] Appl. No.: 756,894

[22] Filed: Jan. 5, 1977

[51] Int. Cl.[2] ..... B68B 5/00; B68B 5/04

[52] U.S. Cl. ..... 54/1; 54/78

[58] Field of Search ..... 54/78, 73, 22, 1

[56] References Cited

U.S. PATENT DOCUMENTS

| | | | |
|---|---|---|---|
| 195,029 | 9/1877 | Lindsay | 54/78 |
| 822,788 | 6/1906 | Tuthill et al. | 54/78 |
| 2,136,032 | 11/1938 | Vanorio, Jr. | 54/1 |
| 2,508,117 | 5/1950 | Lavery, Sr. | 54/78 |

*Primary Examiner*—Hugh R. Chamblee
*Attorney, Agent, or Firm*—Eugene F. Friedman

[57] ABSTRACT

A guard for protecting a horse's tail while supported in a tail set. Curved metal rods, welded together, enclose an area around the horse's tail and prevent contact between it and surrounding objects. Small cloth strips with buckles fasten the metal structure to the straps of a tail set which holds it in the vicinity of the horse's tail. Loops formed from the ends of the metal rods abut the rear quarters of horse and inform it when its tail approaches a surrounding object too closely. As a result, the horse learns to limit its movements so as to avoid contact between such objects and its tail guard.

7 Claims, 3 Drawing Figures

GUARD FOR A HORSE'S TAIL IN A TAIL SET

BACKGROUND OF THE INVENTION

Show horses almost universally have their tails placed in a tail set. The set projects the base of the tail away from the horse's rear quarters at the esthetically pleasing angle generally observed with such animals. In particular, American Saddlebred Horses and Tennessee Walking Horses wear this cosmetic apparatus.

Many horses confined in stables also have their tails carried by tail sets. This arrangement prevents self-inflicted damage that would result from the horses swinging their tails against the sides of their stalls.

To accomodate the tail set, a horse may undergo the severing of the tendons and ligaments at the base of his tail. As a result, the horse no longer fights the tail set, which then completely determines the position of the tail.

The tail, while in a tail set, however, becomes prone to other types of damage. The usual movement of the horse may bring the tail into contact with his stall's walls. The resulting damage may include broken tail bones and abrasions involving hairs pulled out of the tail. Also the tail may catch over any extending rail or even the lower half of the stall's Dutch door, causing further injuries. Once caught, horses may slip out of the tail set, further injuring their tails.

To lessen the incidence of such injuries, some stables install tailboards to keep the horse's rear quarters away from the wall. Located at a height near the middle of the horse's rear legs, the tailboards simply prevent the rearward motion of the horse that can bring his tail into contact with the stall's perimeter.

However, not all stalls include such tailboards. Thus, when a horse travels to shows, for example, so assurance exists that his temporary lodgings will include the protective device for his safety and comfort.

Furthermore, the tailboards, at times, merely relocate the focus of the injuries. The horse's legs, rather than his tail may suffer damage.

SUMMARY

Attaching a guard to the horse assures its availability whenever needed. Moreover, its exact position relative to the horse's anatomy can achieve its protective objective without endangering other parts of the body. When not needed, as during the actual showing of the animal, the guard may readily detach so as not to detract from the horse's appearance or functioning.

To perform its intended purpose, the guard should first include a barrier structure. This barrier must prevent contact between the horse's tail, specifically the base of the tail, and surrounding objects.

A retaining device or means couples to the barrier and holds it in the desired location. Specifically, it should remain in proximity to the rear quarters and the base of the horse's tail.

The tail set itself includes straps that pass near to a horse's tail. Since such straps always occur for a horse in a tail set, the barrier may conveniently couple to these straps of the tail set to hold it in place.

The structure of the barrier may include one or more curved elongated members. In conjunction with a horse's rear quarters, the structure encloses a protected area around the horse's tail.

DETAILED DESCRIPTION

Figure 1:
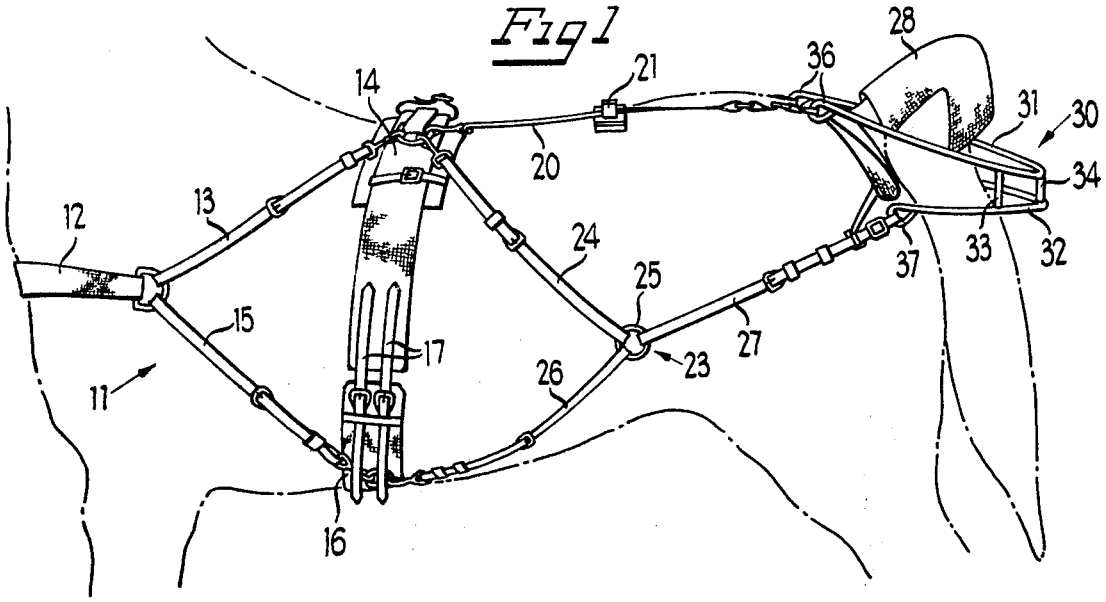
FIG. 1 shows a tail guard attached to a tail set on a horse, shown in phantom.
Figure 2:
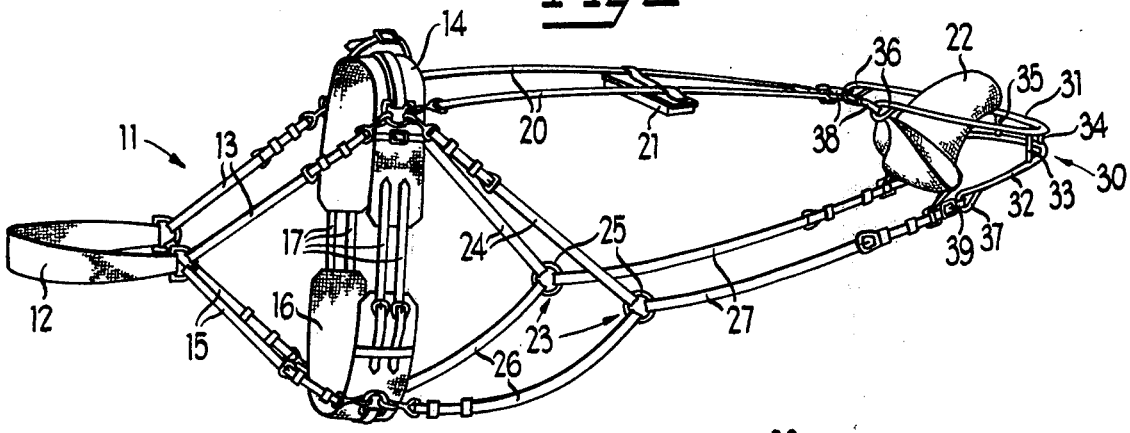
FIG. 2 gives the tail set and guard of FIG. 1 but without the horse.

FIGS. 1 and 2 depict the components of a tail set 11 which serve to support the tail in the position characteristically associated with a show horse. Beginning at the front, the set 11 includes first the breast collar 12 which connects through the upper straps 13 to the back band 14 and through the lower straps 15 to the belly band 16. The straps 17 tie the back band 14 to the belly band 16.

The surcingle 20 connects, in the front, to the backband 14. It passes through the surcingle pad 21 and connects, in the rear, to the top of the base of the crupper 22, seen in FIG. 2 and which actually holds the tail in place. The side straps 23 each include the upper component 24 which couples to the backband 14 and attaches to the ring 25. The lower component 26 similarly extends between the belly band 16 and the ring 25. The rear component 27 goes from the ring 25 to the bottom of the base of the crupper 22.

The surcingle 20 and the side straps 27 hold the crupper 22 securely in place. The tail passes through the crupper 22 to achieve its desired position. The crupper cover 28 covers the tail's base while in the crupper 22.

The guard 30 also couples to the surcingles 20 and the rear components 27 of the strap sets 23. As seen in FIGS. 1 and 2, it surrounds the tail and prevents its contacting surrounding objects.

Figure 3:
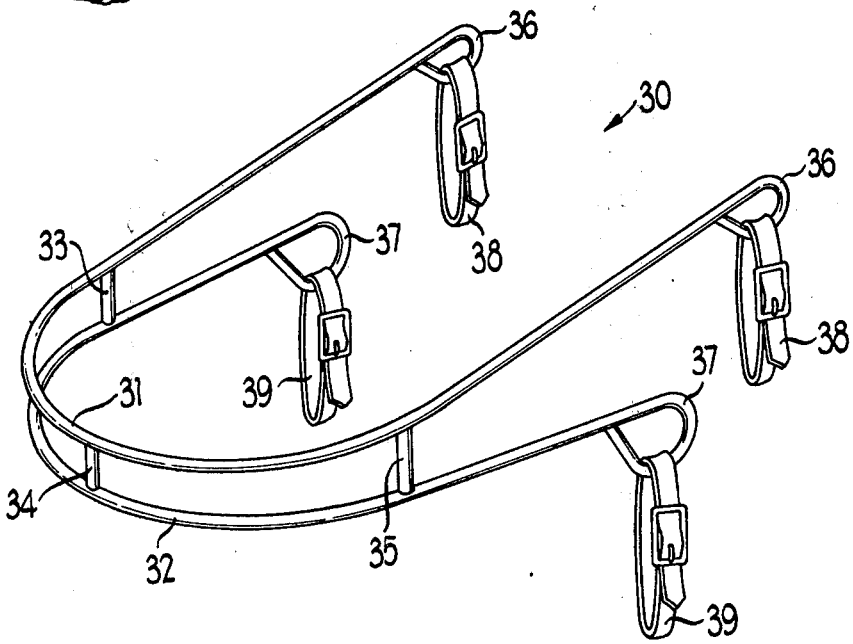
FIG. 3 illustrates the tail guard of FIGS. 1 and 2 with its straps for connection to the tail set.

As seen in FIG. 3, the guard 30 may include the two elongated metal rods 31 and 32 bent into a curved shape. The short straight rod segments 33, 34 and 35 have welded joints with the curved rods and, thus, produce a rigid overall structure. The ends of the upper rod 31 form the metal loops 36 while the lower rod 32 terminates at the loops 37. The two nylon straps 38 pass through the loops 36 of the upper bar 31 and tie around the surcingle straps 20. Similarly, the nylon straps 39 of the lower bar 32 each surround one of the rear components 27. The straps 38 and 39, by coupling the loops 36 and 37, respectively, to the straps 20 and 27, firmly retain the guard 30 in place around the horse's tail. With the horse's own rear quarters, the guard 30 effectively prevents damage to the tail's base.

The guard 30 also serves a further purpose. The loops 36 and 37 have a sufficiently large diameter and the bars a sufficient cross section so that the loops 36 and 37 cannot cut into the horse's flesh and hurt him. However, when the horse's rear approaches a surrounding object too closely, the guard does make contact with that object. And, the impulse of that contact travels through the bars 31 and 32 to the loops 36 and 37 which impinge upon the horse. Thus, the animal receives a less than desirable sensation, but no injury, when it comes too close to the stall's perimeter. He quickly learns the acceptable limits of motion within his stall.

Accordingly, what is claimed is:

1. A guard to prevent damage to a horse's tail while in a tail set comprising:

(A) a shaped elongated rigid barrier means with first and second ends, each of said first and second ends having an upper portion and a lower portion; and (B) retaining means, coupled to said upper portions of said ends and to a tail set, for holding said elongated barrier means onto said tail set in proximity to the rear quarters and the base of the tail of a horse, said lower portion of said ends, when said retaining means hold said barrier means in proximity to a horse's rear quarters, being located lower than and at a fixed nonzero distance from said upper portion and providing to a horse to which attached an indication of when said horse's motion has resulted in bringing into a predetermined area around the base of said horse's tail, a surrounding object, said rigid barrier means, when held by said retaining means in proximity to a horse's rear quarters, defining, with said horse's rear quarters, an enclosed area substantially equal to said predetermined area.

2. The guard of claim 1 wherein said retaining means includes at least two holding straps engageable with both said upper portion of said ends of said barrier means and the straps of a tail set.

3. The guard of claim 1 wherein said barrier means includes first and second shaped rods and connecting member means affixed to said first and second rods for retaining said first and second rods at a fixed distance removed from each other, said first and second rods, when said retaining means holds said barrier means in proximity to the rear quarters of a horse, being removed from each other in a direction that is substantially vertical, said first portions of said ends forming part of said first rod and said second portions of said ends forming part of said second rod.

4. The guard of claim 3 wherein said lower portions of said ends includes rounded ends of said elongated barrier means, said ends being the devoid of sharp edges and, when said retaining means hold said barrier means in proximity to the rear quarters of a horse, abutting substantially directly into the flesh of said rear quarters of said horse.

5. The guard of claim 3 wherein said retaining means holds said barrier means in a position, relative to the rear quarters of a horse, in which said barrier means projects horizontally and rearward beyond said rear quarters of a horse.

6. The guard of claim 3 wherein, when said retaining means holds said barrier means in proximity to the rear quarters of a horse, said barrier means is narrower than the rear quarters of a horse.

7. The guard of claim 6 wherein, when said retaining means holds said barrier means in proximity to the rear quarters of a horse, said barrier means extends no further towards the head of said horse than said horse's rear quarters.

* * * * *